US007721768B2

(12) United States Patent
Iltis et al.

(10) Patent No.: US 7,721,768 B2
(45) Date of Patent: May 25, 2010

(54) LOOM AND A METHOD FOR WEAVING SINGLE-WEB LOOP VELVET

(75) Inventors: Patrick Iltis, Saint Jorioz (FR); Guy Meersschaert, B-Hulse (BE); Henk Lambrecht, B-Kuurne (BE)

(73) Assignee: Staubli Faverges, Faverges (FR)

( * ) Notice: Subject to any disclaimer, the term of this patent is extended or adjusted under 35 U.S.C. 154(b) by 49 days.

(21) Appl. No.: 12/076,918

(22) Filed: Mar. 25, 2008

(65) Prior Publication Data

US 2008/0236700 A1 Oct. 2, 2008

(30) Foreign Application Priority Data

Mar. 30, 2007 (FR) ..... 07 02336

(51) Int. Cl.
*D03D 39/20* (2006.01)
*D03D 39/00* (2006.01)
*D03D 27/00* (2006.01)

(52) U.S. Cl. ..... 139/21; 139/1 R; 139/59; 139/102

(58) Field of Classification Search ..... 139/1 R, 139/2–6, 7 R, 7 A, 7 B, 7 C, 7 D, 7 E, 7 F, 139/7 G, 8–10, 21, 20, 35, 37–47, 59–65, 139/98, 102, 391, 394, 402, 403, 404, 405, 139/408, 411

See application file for complete search history.

(56) References Cited

U.S. PATENT DOCUMENTS

| | | | | |
|---|---|---|---|---|
| 2,141,152 | A | 12/1938 | Kaufman | |
| 2,477,248 | A | 7/1949 | Harding | |
| 2,546,261 | A * | 3/1951 | Groat | 139/44 |
| 2,553,303 | A * | 5/1951 | Crawford | 139/39 |
| 2,981,292 | A * | 4/1961 | Hoeselbarth | 139/39 |
| 5,522,435 | A * | 6/1996 | DeRudder | 139/65 |
| 5,540,262 | A | 7/1996 | Bassi et al. | |
| 6,293,315 | B1 * | 9/2001 | Froment et al. | 139/55.1 |
| 6,357,486 | B2 * | 3/2002 | Braun | 139/59 |

FOREIGN PATENT DOCUMENTS

| | | |
|---|---|---|
| DE | 553 898 C | 7/1932 |
| EP | 0 665 312 A | 8/1995 |
| FR | 2 865 741 A | 8/2005 |

* cited by examiner

*Primary Examiner*—Bobby H Muromoto, Jr.
(74) *Attorney, Agent, or Firm*—Dowell & Dowell, P.C.

(57) ABSTRACT

A single-web loom for loop velvet fabric wherein weft yarns are inserted in a shed ($F_1$) formed by warp yarns and wherein individually controlled electric actuators are used to move at least one warp yarn guide heddle into one of at least four positions ($N_1$, $N_2$, $N_3$, $N_4$) defining at least three warp yarn sheds ($F_1$, $F_2$, $F_3$), and wherein warp yarn guide rods are simultaneously inserted into each of the sheds ($F_2$, $F_3$) other than the shed ($F_1$) into which the weft yarns are inserted for forming loops or pile.

12 Claims, 4 Drawing Sheets

LOOM AND A METHOD FOR WEAVING SINGLE-WEB LOOP VELVET

BACKGROUND OF THE INVENTION

1. Field of the Invention

The invention relates to a single-web loom for weaving loop velvet fabric, and it also relates to a method of weaving such a velvet fabric. Such a velvet fabric may present, in a single row parallel to the weft direction, both loops and pile.

2. Brief description of the Related Art

So-called "loop velvet" looms are single-web looms in which the warp comprises both backing yarns and yarns for forming loops or pile. Such looms present superposed sheds. The bottom shed enables weft to be inserted by rapiers, while higher sheds enable respective rods to be inserted around which some of the warp yarns then form loops. The rods are driven by a device situated on one side of the fabric, which device acts during one pick to insert a rod that it withdrew from the fabric during an earlier pick. Different rods moved by a device situated on one side of the loom can carry respective blades at one end, such blades serving to cut the loops when the corresponding rod is withdrawn, thereby forming two threads of pile. By alternating rods both with and without blades, it is possible to produce a fabric that presents both loops and pile.

In the field of furnishing, there is a strong demand for fabric presenting simultaneously backing effects, loops, and pile. Loop velvet looms make it possible to combine loops and pile of different heights in a single row parallel to the weft direction.

A first method of achieving this objective is shown diagrammatically in FIGS. 1 and 2. It requires four picks A, B, C, and D. Two warp yarns $\mathbf{1}_1$ and $\mathbf{1}_2$ form the backing of the fabric in association with weft yarns 2. During pick A, another warp $\mathbf{1}_3$ forms a loop about a rod 31, prior to being incorporated in the backing of the fabric until the fourth pick D. A fourth warp yarn $\mathbf{1}_4$ forms a loop around the rod 31 and around a rod 32 that carries a blade, this second rod being inserted during the third pick C over the backing of the fabric. By using an appropriate backing weave, such as "4/4" or "2/2", and by inserting no weft yarns during the second and third picks B and C, the beat-up by the comb following the insertion of the second rod 32 during pick C places the second rod 32 above the first rod 31. After the first and second rods 31 and 32 have been withdrawn, a row is formed comprising pile P made using the yarn $\mathbf{1}_4$ and extending away from a midplane Π of the backing of the fabric over a height that is greater than the height of the loop BO. That method is not very productive since it requires four loom picks to produce one row of loops and pile.

Another method consists in inserting a "double iron" member comprising two superposed rods, one for forming a loop and the other, superposed above the first, for forming pile. It is then necessary to form three sheds in order to insert simultaneously backing weft and two rods, thus making it necessary to use shed-forming means capable of placing warp yarns in four different positions. It is then necessary to use four-position Jacquard mechanisms, as disclosed for example in EP-A-0 665 312, making use of a relatively complex and bulky tackle system. The cost price and the complexity of such mechanisms are such that they are little used in practice.

U.S. Pat. No. 5,522,435 makes provision for obtaining four positions from a three-position Jacquard machine combined with a moving support. If such equipment is used with rods, then during the rod extraction pick, the warp yarns can be placed beneath or above the weft, and also between the rods.

During the rod insertion pick, the yarns can be placed beneath or above the pile rod, or above the weft. Such an approach does not make it possible to place a pile or loop yarn beneath the weft in order to create a backing effect.

In another approach, it is possible to combine two three-position Jacquard devices. The shed of the first device is adjusted so as to be capable of controlling the loop yarns, while the shed on the second device is adjusted so as to be capable of controlling the pile yarns. That solution reduces options for weaving since the warp yarns for the loops cannot be used to form pile, and vice versa.

Thus, weaving options with known devices on a loop velvet loom are limited both in terms of flexibility and in terms of the productivity that is obtained.

SUMMARY OF THE INVENTION

The invention seeks more particularly to remedy those drawbacks by proposing a novel loop velvet loom in which loops and pile can be obtained easily, at a high rate of production and with limited risks of defects.

To this end, the invention provides a single-web loom for loop velvet fabric, the loom comprising means for inserting weft yarns in a first shed formed by warp yarns and also:

- electric actuators under individual control and each suitable for moving at least one heddle for guiding a warp yarn into one of at least four positions defining at least three warp yarn sheds; and
- means for simultaneously inserting into each of the sheds other than the first shed a respective warp yarn guide rod for forming loops or pile.

By means of the invention, the use of individually controlled electric actuators makes it possible to organize the warp yarns in such a manner as to form at least three superposed sheds dedicated respectively to inserting weft yarns and to inserting two guide rods, in such a manner that during a single pick, a weft yarn and two rods can be put into place in these three sheds. In addition, the individually controlled electric actuators make it possible to adjust the motion profiles of the heddles in such a manner that the sheds that are formed are optimized both relative to passing rods and to passing weft yarn guide rapiers.

According to an advantageous characteristic, the actuators are suitable for imparting to the heddles at least four positions defining sheds such that the distances between pairs of these positions measured perpendicularly to a weft yarn insertion plane is different from the distance measured between two other ones of these positions.

Furthermore, at least one of the rods may be fitted with a blade for cutting the loops that are formed around the rod, thus enabling pile to be made.

Advantageously, the actuators are suitable for imparting at least one motion profile to some of the heddles such that the distance between two webs of warp yarns, as measured at a comb of the loom, remains constant during insertion of the rods. This makes it possible to optimize the volume available for inserting rods and limits the risk of the rods passing through the warp yarns forming the webs.

The invention also provides a method of weaving a single-web loop velvet that can be implemented with a loom as described above, and more specifically it provides a method in which weft yarns are inserted in a first shed formed by warp yarns, and comprising the steps consisting in:

a) controlling the positions of the warp yarns by means of individually-controlled electric actuators, bringing at least one warp-yarn guide heddle into at least four positions defining at least three sheds; and b) inserting simultaneously, into each of the sheds other than the first shed, a respective guide rod for guiding warp yarns for forming loops or pile.

In aspects of the invention that are advantageous but not essential, such a method may incorporate one or more of the following characteristics:

- The distance between two of the at least four positions measured perpendicularly to an insertion plane for weft yarns is different from the distance measured between two other ones of these positions. Under such circumstances, the distances between the positions defining respective sheds into which there are inserted firstly the weft yarns and secondly the rods, are adapted firstly to the height(s) of the weft yarn insertion rapier(s), and secondly to the height of each of the rods, these heights being measured perpendicularly to the weft yarn insertion plane.
- The profile of the shed into which the weft yarns are inserted is asymmetrical and adapted to the shape of the weft yarn insertion rapier(s).
- The motion profile of at least some heddles includes at least one top plateau corresponding substantially to maintaining a maximum shed height over a given angular range of the movement of the loom shaft.
- The motion profile of at least some heddles is such that the distance between two webs of warp yarns, as measured at a comb of the loom, remains substantially constant during rod insertion. Under such circumstances, provision can be made for the motion profile of at least some heddles to include a top portion presenting an inflection inducing a momentary reduction in the shed height synchronously with the passage of the comb through a portion of its stroke corresponding to a maximum spacing from the beat-up point.
- The heddle motion amplitudes and/or profiles are variable as a function of the positions of the heddles across the width of the fabric.

BRIEF DESCRIPTION OF THE DRAWINGS

The invention can better be understood and other advantages thereof appear more clearly in the light of the following description of two embodiments of a loom and of a method in accordance with the invention, given purely by way of example and made with reference to the accompanying drawings, in which.

DESCRIPTION OF THE PREFERRED EMBODIMENTS

Figure 3:
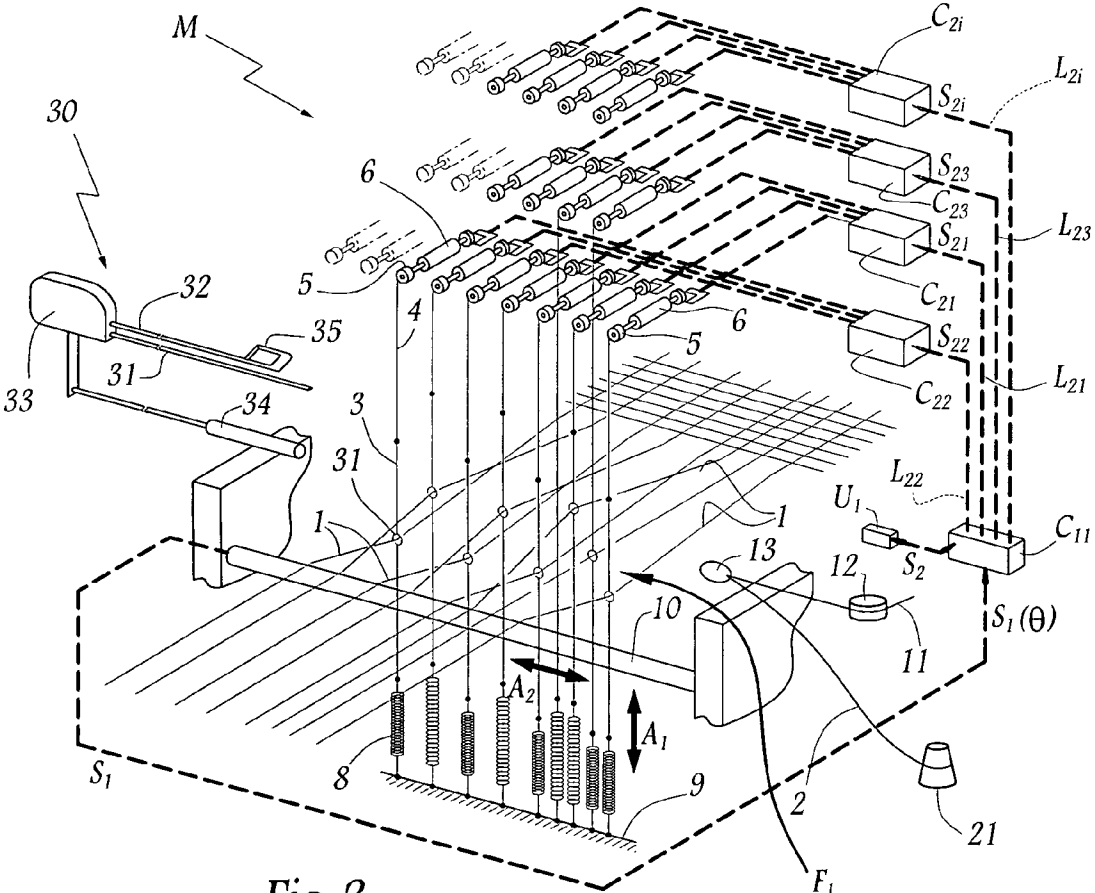
FIG. 3 is a diagram showing the principle of a loom in accordance with the invention.

The single-web loom M shown diagrammatically in FIG. 3 is fitted with warp yarns 1 each passing through an eyelet 31 of a heddle 3 driven with vertical reciprocating motion represented by double-headed arrow $A_1$, this motion being generally perpendicular to the travel direction of the weft yarns represented by double-headed arrow $A_2$. Each heddle 3 is connected by a cord 4 to a pulley 5 turned by an electric actuator 6, e.g. a servo-motor of the type described in FR-A-2 772 791. In its bottom portion, each heddle is connected to a return spring 8 secured to the frame 9 of the loom M.

In practice, the number of actuators 6 in the loom M can be very large, e.g. of the order of 10,000 or more.

To control the actuators 6, a central computer $C_{11}$ is used together with a plurality of offset computers $C_{21}$, $C_{22}$, $C_{23}$ . . . , $C_{2i}$. Each computer $C_{2i}$ is located close to servo-motors 6 under its control, while also being connected to the central computer $C_{11}$ via an electrical connection $L_{2i}$. The computer $C_{11}$ receives a signal $S_1$ representative of the instantaneous position of the loom M in its cycle, e.g. the instantaneous angular position θ of its main shaft 10.

The computer $C_{11}$ is also connected to a unit $U_1$ in which the references of the desired weave are stored. Depending on the weave to be woven, the computer $C_{11}$ receives from the unit $U_1$ a signal $S_2$ representative of the type of motion profile that is to be followed by each heddle 3 as actuated by each servo-motor 6 under control of one of the computers $C_{2i}$.

This is done in application of the technical teaching of FR-A-2 865 741, it being understood that other approaches could be used for individually controlling the servo-motors 6.

A flexible rapier 11 is provided for inserting a weft yarn 2 in a shed $F_1$ defined between two webs of warp yarn 1. The weft yarn 2 comes from a feed device 21, with the movement of the rapier 11 being controlled by a sprocket wheel 12. Other means could be provided for driving the rapier 11 into the shed $F_1$ or for extracting it therefrom. The rapier 11 is fitted with a gripper 13 for engaging the weft yarn 2.

The loom M also has a device 30 for inserting two rods 31 and 32 in two other sheds formed by the warp yarns 1 above the shed $F_1$. The two rods 31 and 32 are mounted on a support 33, and driven by means of an actuator 34 to move parallel to the direction for inserting warp yarns into the shed, as represented by double-headed arrow $A_2$.

The rod 31 presents a circular section over its entire length. In a variant, the section of the rod 31 could be rectangular over its entire length. At its end remote from the support 33, the rod 32 caries a blade 35 for cutting warp yarns 1.

Figure 5:
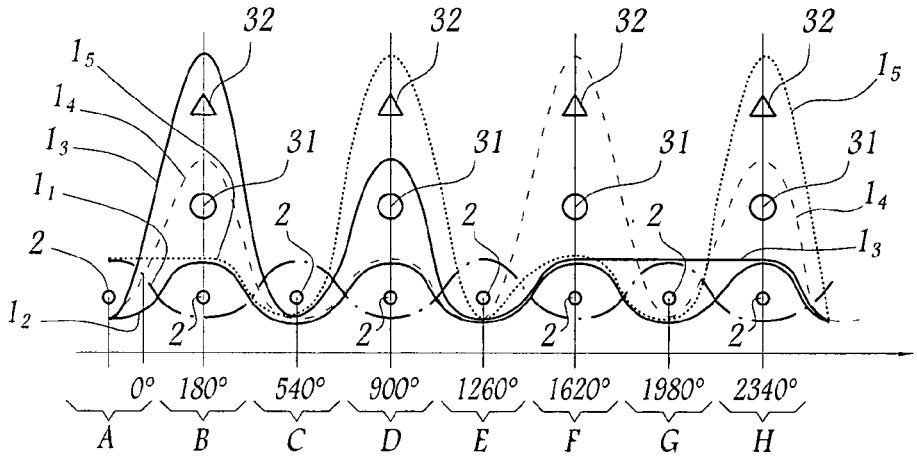
FIG. 5 is a diagram showing the positions of various warp yarns during weaving on the FIG. 3 loom.

With reference to FIG. 5, consideration is given to eight picks given respective references A to H, each pick extending over one 360° revolution of the shaft 10. A reference position θ=0° for the shaft 10 is taken arbitrarily as being its position when it passes between the picks A and B.

Two warp yarns $\mathbf{1}_1$ and $\mathbf{1}_2$ form the binding warp of the fabric being woven and they co-operate with the weft yarns 2 to constitute the backing of the fabric. Three other warp yarns $I_3$, $I_4$, and $I_5$ are used to form loops and pile extending upwards from the backing of the fabric.

During pick B, the yarn $I_3$ passes over two rods 31 and 32 before passing under the weft yarn 2 during pick C, and then between the rods 31 and 32 in pick D, prior to being incorporated in the backing of the fabric as from pick E. The yarn $\mathbf{1}_4$ passes between the rods 31 and 32 in pick B and then into the backing of the fabric between picks C and E, prior to passing over rod 32 during pick F and over rod 31 during pick H. Yarn $\mathbf{1}_5$ is integrated in the backing of the fabric until pick C, and then passes over rod 32 during pick D prior to being integrated in the backing of the fabric during pick F and then over the rod 32 during pick H.

Naturally, other combinations could be envisaged depending on the pattern to be made.

Figure 1:
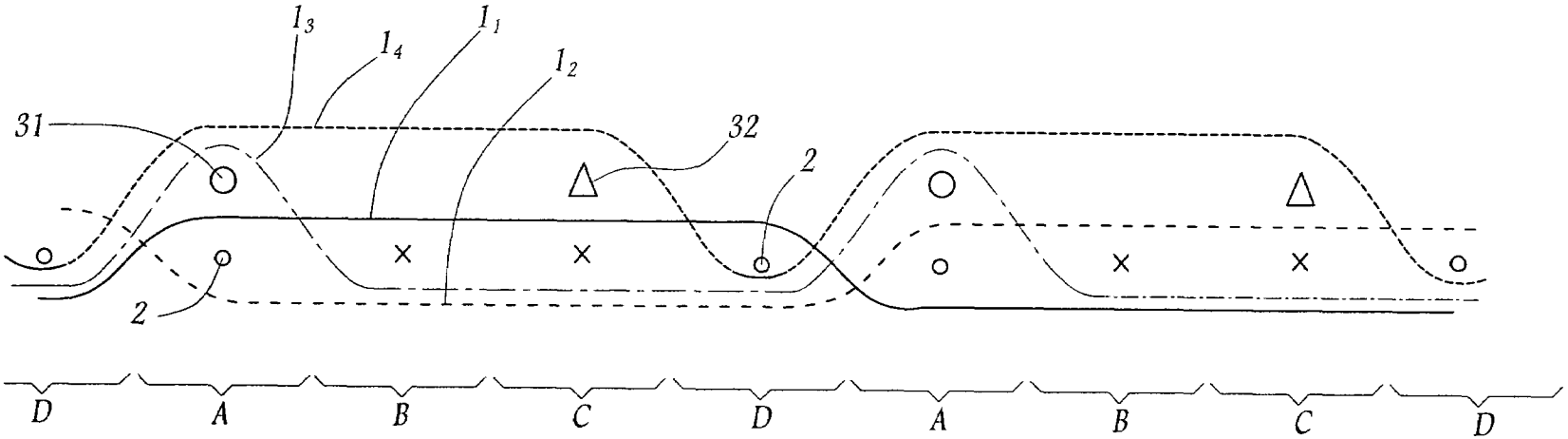
FIGS. 1 and 2 are diagrams showing the principle of a weaving method in the state of the art.
Figure 2:
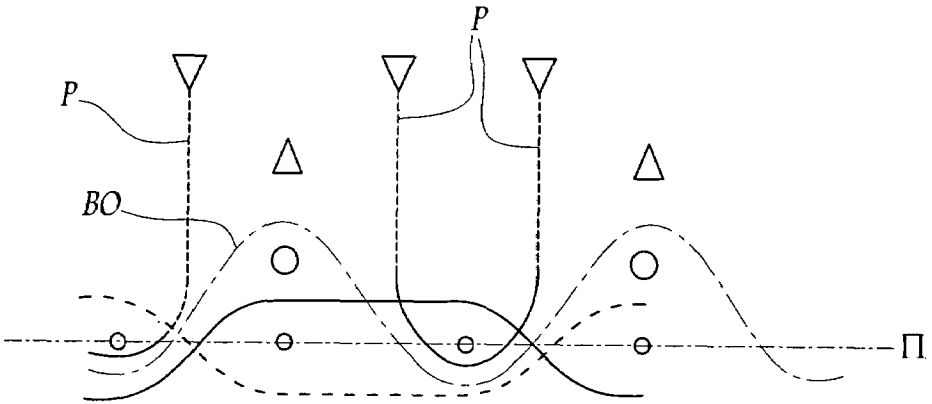
Figure 4:
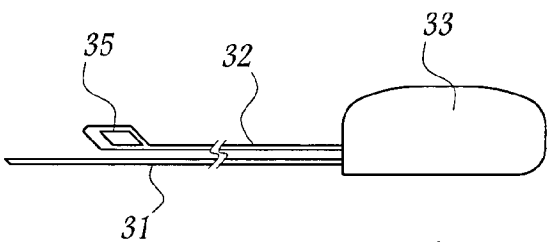
FIG. 4 is a side view of a set of two rods used in the loom of FIG. 3.

When the rods 31 and 32 are withdrawn from the sheds in which they are engaged, the yarns passing over the rod 32 are cut by the blade 35 so as to form pile threads, as explained for the pile P shown in FIG. 2. The yarns passing solely over the rods 31 form loops that remain in the fabric.

In practice, the device 30 comprises a plurality of supports 33 fitted with rods 31 and 32 and controlled by an actuator or the equivalent, thereby enabling the rods 31 and 32 to be kept engaged between the warp yarns for a few picks after the portion of the fabric in which they are engaged has gone beyond the beat-up point $P_F$.

Figure 6:
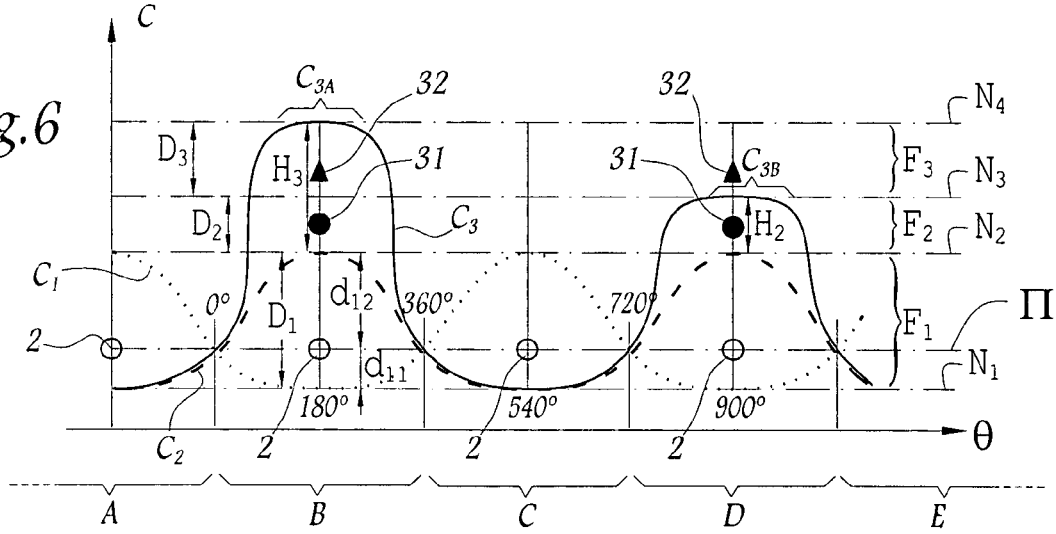
FIG. 6 is a diagram showing the stroke of certain heddles during the first four picks shown in FIG. 5.

As can be seen more particularly in FIG. 6, the stroke C of the various heddles 3 is a function of the loom angle θ. Reference is made to a plane Π in which the various weft yarns 2 are inserted during successive picks in the operation of the loom. Curves $C_1$, $C_2$ represent respectively the positions of yarns $\mathbf{1}_1$ and $\mathbf{1}_2$ in the configuration of FIG. 5. The respective bottom and top dead centers of the curves $C_1$ and $C_2$ define the positions of two webs $N_1$ and $N_2$ of warp yarns placed in the loom M and defining between them the shed $F_1$ into which the weft yarns 2 are inserted in succession. The amplitude of the shed $F_1$ is written $D_1$, this amplitude being equal to the distance between the webs $N_1$ and $N_2$. The distance between the plane Π and the web $N_1$ is written $d_{11}$ and the distance between the plane Π and the web $N_2$ is written $d_{12}$. The distance $d_{11}$ is shorter than the distance $d_{12}$, such that the plane Π is closer to the web $N_1$ than to the web $N_2$. In other words, the profile of the curves $C_1$ and $C_2$ is asymmetrical, thus enabling the shape of the bottom portions of these curves to be adapted, i.e. the portion situated between the plane Π and the web $N_1$, in order to guide the rapier 11 as it moves inside the shed $F_1$. Thus, the shape of the shed $F_1$ serves to improve the stability of the rapier during its movements along arrow $F_2$.

The asymmetrical distribution of the webs $N_1$ and $N_2$ on either side of the plane Π would not be possible with a conventional double-lift Jacquard device which would impose a symmetrical profile on the curves $C_1$ and $C_2$. Thus, by using servo-motors 6 that can be programmed easily to obtain the curves $C_1$ and $C_2$, the movements of the heddles can be defined without compromise for optimizing the travel of the weft yarns 2.

In FIG. 6, the curve $C_3$ shows the position of the heddle controlling the yarn $\mathbf{1}_3$ of FIG. 5. This curve serves to define a third web $N_3$ corresponding to the position of a warp yarn when it is to pass between the rods 31 and 32. The curve $C_3$ is tangential to the web $N_3$ during pick D. The distance between the webs $N_2$ and $N_3$ is written $D_2$.

The curve $C_3$ also makes it possible, by means of its highest point, to define a web $N_4$ corresponding to the position of a warp yarn when it is to pass over the rod 32. The distance between the webs $N_3$ and $N_4$ is written $D_3$.

The webs $N_1$ to $N_4$ thus correspond to four positions for the eyelet 31 of a heddle 3 under the control of a servo-motor 6. These positions, i.e. the values of the distances $d_{11}$, $d_{12}$, $D_2$, and $D_3$ can easily be adjusted by means of the computers $C_{11}$, $C_{21}$, . . . , $C_{2i}$.

Advantageously, the distances $D_1$, $D_2$, and $D_3$ are different, being adapted to the shape of the parts that pass respectively in the shed $F_1$, in the shed $F_2$ defined between the webs $N_2$ and $N_3$, and in a shed $F_3$ defined between the webs $N_3$ and $N_4$. More precisely, the distance $D_1$ is determined as a function of the height of the gripper 13, while the distances $D_2$ and $D_3$ are determined respectively as a function of the heights of the rods 31 and 32.

In the above, the concept of "height" corresponds to the dimension of an article as measured perpendicularly to the plane Π.

Close to its highest point, i.e. in the proximity of the web $N_4$, the curve $C_3$ includes a portion $C_{3A}$ that is tangential to the position of the web $N_4$, thereby forming a top plateau corresponding overall to maintaining a maximum shed height $H_3$ relative to the web $N_2$ over a range of loom angles centered about the value 180°. This enables the shed $F_3$ to be held open long enough to guarantee a passage without collision for the rod 32.

Similarly, when tangential to the web $N_3$, the curve $C_3$ presents a second plateau $C_{3B}$ in which the height of the shed $H_2$ is maintained substantially constant over a range of loom angles centered about an angle θ equal to 900°.

Figure 7:
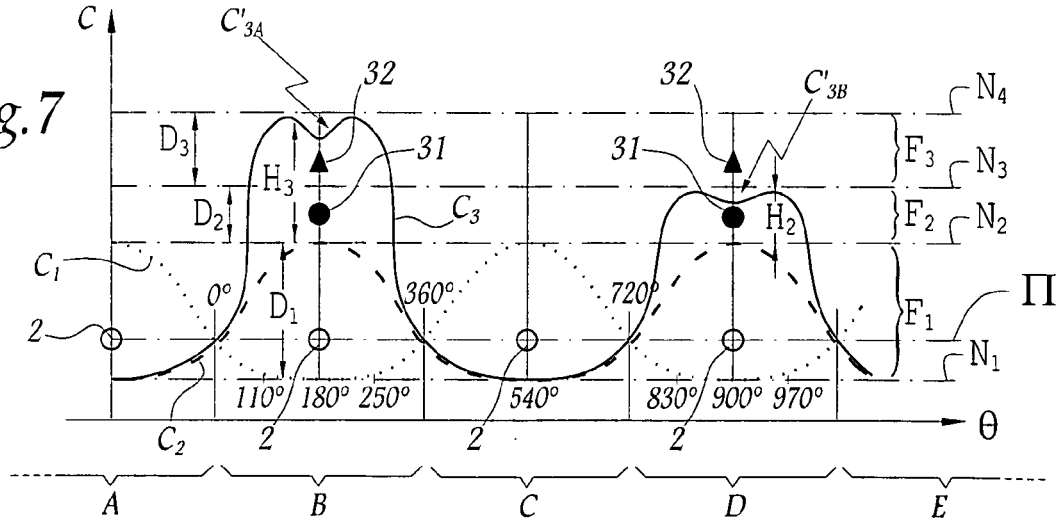
FIG. 7 is a view analogous to FIG. 6 for a method in accordance with a second implementation of the invention.

In the variant of the method of the invention shown in FIG. 7, the curves $C_1$ and $C_2$ are identical to those shown in FIG. 6. In the vicinity of the web $N_4$, the curve $C_3$ presents an inflection $C'_{3A}$ that corresponds to a momentary reduction in the opening angle of the shed $F_3$, i.e. the shed height $H_3$. Similarly, an inflection zone $C'_{3B}$ is provided in the curve $C_3$ in the vicinity of the web $N_3$, corresponding to a momentary reduction in the opening angle of the shed $F_2$, i.e. in the height $H_2$.

Figure 8:
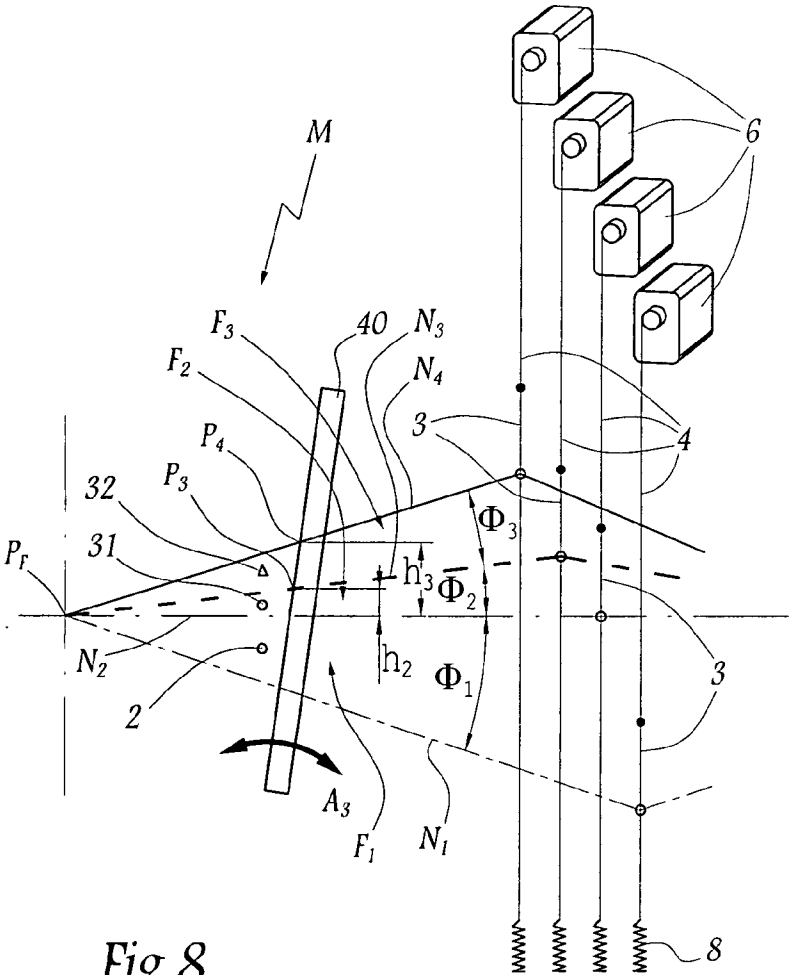
FIG. 8 is a diagrammatic side view of a loom in accordance with the invention in a first configuration corresponding to a first loom angle in the context of the FIG. 7 method.

With reference more particularly to FIG. 8, the opening angles of the sheds $F_1$, $F_2$, and $F_3$ are written $\Phi_1$, $\Phi_2$, and $\Phi_3$. The height of the shed $F_2$ as measured between the web $N_2$ and a point of entry $P_3$ of the web $N_3$ in a comb 40 belonging to the loom M is written $h_2$. Similarly, the height of the shed $F_3$ as measured between the web $N_2$ and an entry point $P_4$ of the web $N_4$ in the comb 40 is written $h_3$. The comb 40 is driven with tilting motion represented by double-headed arrow $A_3$, the comb going away from the beat-up point $P_F$ when the loom angle approaches and passes through the value 180°. The position of FIG. 8 corresponds to a loom angle of 110°, while the position of FIG. 9 corresponds to a loom angle of 180°.

Figure 9:
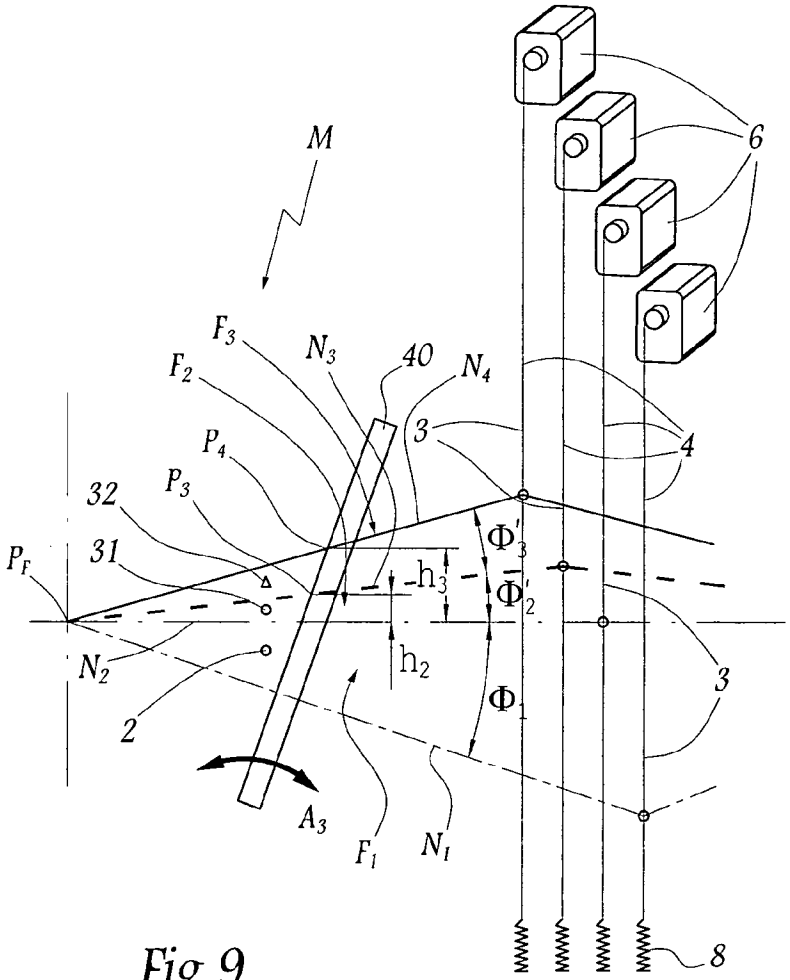
FIG. 9 is a view analogous to FIG. 6 when the loom is in a second configuration corresponding to a second loom angle.

The shape of the curve $C_3$ with the inflection zones $C'_{3A}$ and $C'_{3B}$ of FIG. 7 means that when the loom angle passes from the value 110° to the value 180°, the opening angles $\Phi_2$ and $\Phi_3$ of the sheds $F_2$ and $F_3$ decrease so as to reach the value $\Phi'_2$ and $\Phi'_3$ as shown in FIG. 9, whereas while the comb 40 tilts away from the beat-up point $P_F$ and the heights $h_2$ and $h_3$ remain constant.

This provides good guidance for the rods 31 and 32 that move in a space, i.e. respectively the portions of the sheds $F_2$ and $F_3$ that lie between the beat-up point $P_F$ and the comb 40, in which heights $h_2$ and $h_3$ vary little or not at all over time.

Specifically, a heddle 3 needs to reach its maximum height position, shown for values 110° and 830° in FIG. 7, at the beginning of insertion of the rods 31 and 32. Thereafter, it can move back down a little, as represented by the inflection zones $C'_{3A}$ and $C'_{3B}$ until the comb reaches its rearmost position shown in FIG. 9. Thereafter, the heddle rises up to a second maximum height position which it reaches at a loom angle having a value of 250° or 970°, while rod insertion terminates.

Furthermore, since the warp yarns are controlled individually by the actuators 6, it is possible to give different amplitudes or motion profiles to heddles depending on their positions across the width of the fabric. For example, in the embodiment of FIG. 6, in order to facilitate rod insertion, the motion profiles of heddles at the edges of the fabric may present zones $C'_3$ and $C''_3$ that form plateaus with an angular amplitude that is greater than that used for the remainder of the fabric. In other words, the plateau zones $C'_3$ and $C''_3$ shown in FIG. 6 can be wider for heddles close to the edges of the fabric, at least on the side from which the rods 31 and 32 are inserted. In the second method shown in FIG. 7, it is the spacing between the maximum height zones of the curve $C_3$ that can be increased in the vicinity of this edge.

The invention is described above for a fabric that presents over a single row both loops and cut pile. The height of the pile is greater than the height of the loop. Nevertheless, in the ambit of the present invention it is possible to obtain on a single row solely pile of differing heights or solely loops of differing heights, depending on whether the rods 31 and 32 are or are not provided with a cutter blade such as the blade 35 at their respective ends.

The invention is described above with a support 33 carrying two rods 31 and 32 and being moved from one side only relative to the sheds. Satisfactory results can also be obtained in a loom having two distinct devices for inserting and withdrawing rods that are used, e.g. from respective sides of the loom.

In an aspect of the invention that is not shown, the actuators 6 of the loom may serve to control more than four positions for the heddles 3, i.e. to control more than three sheds, thus making it possible to envisage inserting three or more rods into three sheds in addition to the backing shed $F_1$ of the fabric. It is then possible to obtain three different heights for loops or pile.

In the embodiment described above, the shed-forming device is a yarn-to-yarn Jacquard device having independent actuators 6. Nevertheless, the invention also applies to a loop velvet loom associated with a shed-forming device constituted by independent actuators each connected to a plurality of heddles, by means of cords extending in parallel or via a frame of the kind known in looms fitted with dobbies or with cam mechanisms.

The invention claimed is:

1. A single-web loom for loop velvet fabric, the loom comprising:

a plurality of electric actuators, each actuator being connected to move at least one heddle for guiding a warp yarn into one of at least four positions defining at least three warp yarn sheds;

a plurality of individual controls for controlling operation of the electric actuators;

means for inserting weft yarns in a first shed formed by warp yarns; and means for simultaneously inserting into each of the sheds other than the first shed formed by warp yarns a respective warp yarn guide rod for forming loops or pile.

2. A loom according to claim 1, wherein the actuators move the heddles to at least four positions defining sheds and such that distances between pairs of these positions, measured perpendicularly to a weft yarn insertion plane, is different from a distance measured between two other ones of these positions.

3. A loom according to claim 1, wherein at least one of the rods is fitted with a blade for cutting loops that are formed around the at least one rod.

4. A loom according to claim 1, wherein the actuators impart at least one motion profile to some of the heddles such that a distance between two webs of warp yarns, as measured at a comb of the loom, remains constant during insertion of the rods.

5. A method of weaving single-web loop velvet in which weft yarns are inserted in a first shed formed by warp yarns, wherein the method comprises the steps consisting in:

a) controlling the positions of the warp yarns by means of individually-controlled electric actuators, bringing a plurality of warp-yarn guide heddles into at least four height positions defining at least three sheds; and b) inserting simultaneously, into each of the sheds other than the first shed, a respective guide rod for guiding warp yarns for forming loops or pile.

6. A method according to claim 5, moving the at least one warp yarn guide heddle a first height distance between two of the at least four positions measured perpendicularly to an insertion plane for weft yarns and moving the at least one warp yarn guide heddle a second height distance, which is different than the first distance, between two other ones of the at least four positions.

7. A method according to claim 6, wherein the including moving the at least one warp yarn guide heddle a first height distance which is equal to a height of a weft yarn insertion rapier and moving the at least one warp yarn guide heddle a second height distance which is equal to a height between each of the rods, and the first and second heights being measured perpendicularly to the weft yarn insertion plane.

8. A method according to claim 5, including creating a profile of the shed which is asymmetrical so as to receive weft yarn being inserted by a rapier.

9. A method according to claim 5, including moving some of the heddles so that the shed height is maintained at at least one top plateau corresponding substantially to a maximum shed height over a given angular rotation of a main loom shaft.

10. A method according to claim 5, including moving some of the heddles such that a distance between two webs of warp yarns, as measured at a comb of the loom, remains substantially constant during insertion of the rods.

11. A method according to claim 5 including moving some of the heddles to a maximum shed height and reducing the maximum shed height synchronously with a passage of a comb through a portion ($\theta$=180°) of its stroke corresponding to a maximum spacing from a beat-up point.

12. A method according to claim 5, including moving the heddles to varying heights as a function of positions of the heddles across a width of a fabric being woven.

* * * * *